US008632150B2

(12) United States Patent
Kasai et al.

(10) Patent No.: US 8,632,150 B2
(45) Date of Patent: Jan. 21, 2014

(54) PRINTHEAD SUBSTRATE, PRINTHEAD AND PRINTING APPARATUS

(75) Inventors: Ryo Kasai, Tokyo (JP); Nobuyuki Hirayama, Fujisawa (JP); Tomoko Kudo, Kawasaki (JP); Tatsuo Furukawa, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 499 days.

(21) Appl. No.: 12/942,377

(22) Filed: Nov. 9, 2010

(65) Prior Publication Data

US 2011/0122181 A1 May 26, 2011

(30) Foreign Application Priority Data

Nov. 26, 2009 (JP) ..... 2009-269264

(51) Int. Cl.
*B41J 2/11* (2006.01)

(52) U.S. Cl.
USPC ..... 347/10

(58) Field of Classification Search
USPC ..... 347/14, 10
See application file for complete search history.

(56) References Cited

U.S. PATENT DOCUMENTS 6,971,735 B2 12/2005 Saito et al.
7,267,429 B2 9/2007 Furukawa
7,850,262 B2 12/2010 Hirayama et al.
2002/0180814 A1 12/2002 Tamura
2004/0125157 A1 7/2004 Edelen et al.
2005/0264608 A1 * 12/2005 Hirayama ..... 347/54
2007/0165055 A1 7/2007 Hirayama et al.
2008/0129790 A1 6/2008 Kasai

FOREIGN PATENT DOCUMENTS

JP 2005-199703 A 7/2005
JP 2007-22069 A 2/2007
JP 2007022069 A * 2/2007 ..... B41J 2/05

* cited by examiner

*Primary Examiner* — Laura Martin
(74) *Attorney, Agent, or Firm* — Fitzpatrick, Cella, Harper & Scinto

(57) ABSTRACT

A printhead substrate comprises: a plurality of printing elements arrayed in a predetermined direction; first logic circuits arranged in correspondence with respective groups each assigned to a predetermined number of adjacent printing elements, and configured to select a printing element to be driven from the printing elements belonging to each of the groups; driving circuits configured to drive the printing elements based on signals output from the first logic circuits; second logic circuits configured to supply externally input printing data to the first logic circuits corresponding to the respective groups; and electricity storage units arranged in the respective groups, connected to a power supply line for supplying power to at least one of the first logic circuits, the second logic circuits, and the driving circuits, and configured to store charges in accordance with a voltage applied through the power supply line.

8 Claims, 13 Drawing Sheets

PRINTHEAD SUBSTRATE, PRINTHEAD AND PRINTING APPARATUS

BACKGROUND OF THE INVENTION

1. Field of the Invention

The present invention relates to a printhead substrate, printhead, and printing apparatus.

2. Description of the Related Art

There is known a printing apparatus which prints information such as a text or image on printing medium such as paper or a film. Most printing apparatuses of this type adopt a serial printing method of printing while reciprocally scanning in a direction perpendicular to the printing medium feeding direction. The serial printing method has advantages such as easy cost reduction and easy downsizing.

Of these printing apparatuses, a printing apparatus complying with an inkjet printing method (to be referred to as an inkjet printing apparatus) is known. The inkjet printing apparatus includes, for example, a printhead which prints using thermal energy (see Japanese Patent Laid-Open No. 2005-199703).

The printhead has an inkjet printhead substrate (to be simply referred to as a printhead substrate). FIG. 7A is a view exemplifying the circuit layout of a conventional inkjet printhead substrate 500. FIG. 7B is a circuit diagram exemplifying a circuit arrangement for driving an array of heaters 502 on the printhead substrate 500 shown in FIG. 7A.

As shown in FIG. 7A, the printhead substrate 500 includes heaters, transistor drivers, high-voltage logic circuits, logic circuits, and the like. As shown in FIG. 7B, various different driving powers are supplied to the respective portions. To increase the printing process speed and image quality, the printhead substrate 500 tends to increase the number of heaters and elongate the substrate shape.

In general, printhead substrates are promoting efficient circuit arrangements for downsizing and the like. However, the printhead substrate requires an ink supply port 501 as shown in FIG. 7A, which greatly restricts the circuit arrangement, compared to a general IC whose shape is arbitrary. Since the substrate shape tends to be long, as described above, a long circuit arrangement along the heater array is necessary. For a long substrate shape, a long power supply line needs to be laid out from a pad at the end of the substrate. The parasitic C, R, and L of the power supply line may make the power supply unstable, causing a malfunction.

On the printhead substrate, a pulse current of several ten mA per heater or several A per entire substrate flows at once to cause film boiling of ink. The pulse current flows through an aluminum wire running through the entire upper layer of the substrate circuit. Thus, noise superposed on the circuit power supply becomes greatly large, compared to a general IC. In particular, a logic circuit 505 shown in FIGS. 7A and 7B needs to be driven quickly at low voltage. However, under layout restrictions, the logic circuit 505 is arranged parallel to the lower layer of the aluminum wire through which the heater pulse current flows, and thus is greatly affected by noise.

Since the number of heaters increases, as described above, noise tends to further increase. A larger number of heaters require higher circuit driving speed (higher frequency), and the power supply becomes unstable along with an increase in power consumption. Also, high-speed driving increases power supply noise, and the risk of the malfunction of the circuit rises. That is, stabilization of the power supply on the substrate is an important issue.

SUMMARY OF THE INVENTION

The present invention provides a printhead substrate, printhead, and printing apparatus which stabilize the power supply on the substrate.

According to a first aspect of the present invention, there is provided a printhead substrate comprising: a plurality of printing elements arrayed in a predetermined direction; first logic circuits arranged in correspondence with respective groups each assigned to a predetermined number of adjacent printing elements, and configured to select a printing element to be driven from the printing elements belonging to each of the groups; driving circuits configured to drive the printing elements based on signals output from the first logic circuits; second logic circuits configured to supply externally input printing data to the first logic circuits corresponding to the respective groups; and electricity storage units arranged in the respective groups, connected to a power supply line for supplying power to at least one of the first logic circuits, the second logic circuits, and the driving circuits, and configured to store charges in accordance with a voltage applied through the power supply line.

According to a second aspect of the present invention, there is provided a printhead on which the above-described printhead substrate is mounted.

According to a third aspect of the present invention, there is provided a printing apparatus comprising a printhead on which the above-described printhead substrate is mounted, wherein the printing apparatus prints by scanning the printhead relatively to a printing medium.

Further features of the present invention will be apparent from the following description of exemplary embodiments with reference to the attached drawings.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an ink-jet printing system. However, the present invention is not limited to such specific system. For example, an electrophotography system using toners as color materials may be adopted.

The printing apparatus may be, for example, a single-function printer having only a printing function, or a multi-function printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

First Embodiment

Figure 1:
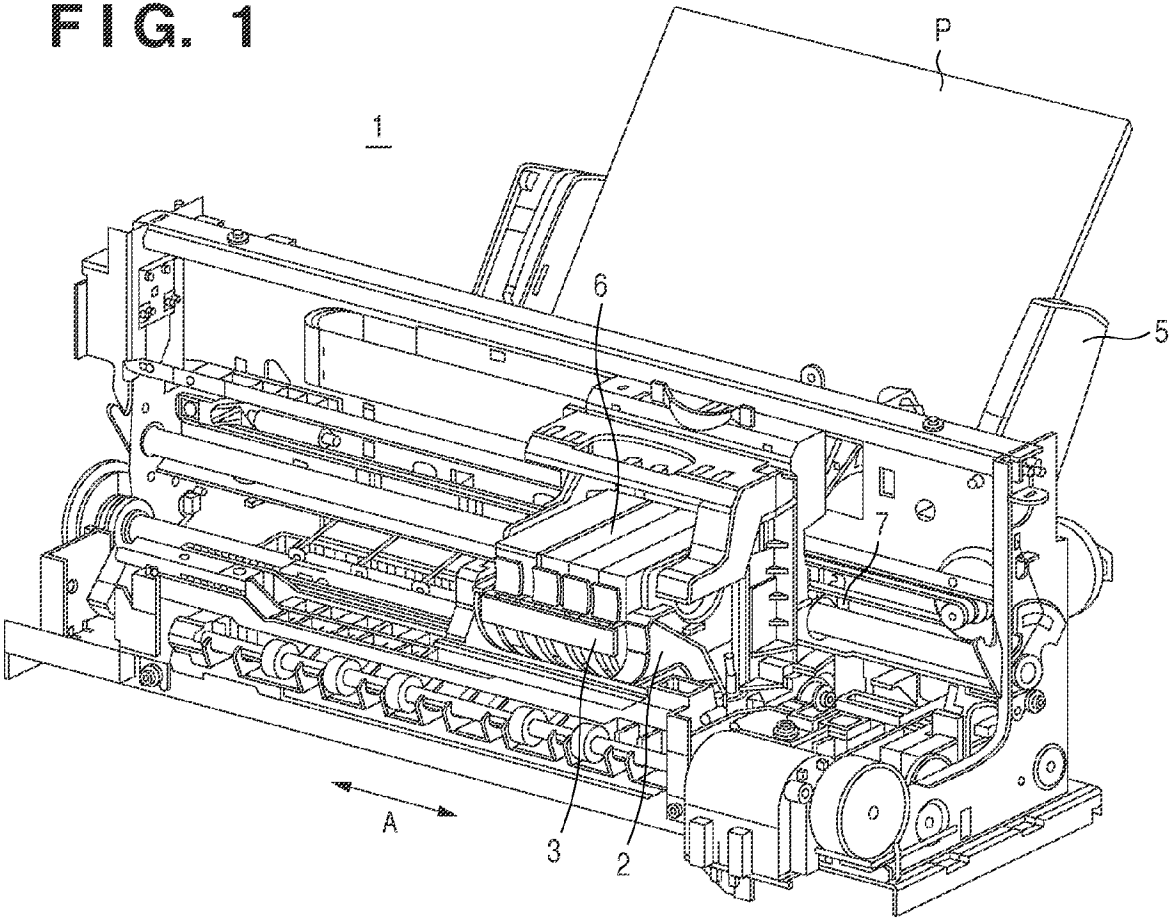
FIG. 1 is a perspective view exemplifying the outer appearance of an inkjet printing apparatus 1 according to an embodiment of the present invention.

FIG. 1 is a perspective view exemplifying the outer appearance of an inkjet printing apparatus 1 according to an embodiment of the present invention.

In the inkjet printing apparatus (to be referred to as a printing apparatus) 1, an inkjet printhead (to be referred to as a printhead) 3 for printing by discharging ink according to an inkjet method is mounted on a carriage 2. The printing apparatus 1 prints by reciprocating the carriage 2 in a predetermined direction. The printing apparatus 1 feeds a printing medium P such as printing paper via a paper feed mechanism, and conveys it to a printing position. At the printing position, the printhead 3 discharges ink to the printing medium P to print.

The printhead 3 according to the first embodiment adopts an inkjet method of discharging ink using thermal energy. Hence, the printhead 3 includes heat generation elements. The heat generation elements are arranged in correspondence with respective orifices, and a pulse voltage corresponding to a printing signal is applied to a corresponding heat generation element. In response to this, the ink is discharged from a corresponding orifice.

For example, an ink tank 6 is mounted on the carriage 2, in addition to the printhead 3. The ink tank 6 stores ink to be supplied to the printhead 3. In the printing apparatus 1 shown in FIG. 1, five ink tanks 6 which store mat black (MBk), magenta (M), cyan (C), yellow (Y), and black (K) inks, respectively, are mounted on the carriage 2. The five ink tanks 6 are independently mountable/demountable.

Figure 2:
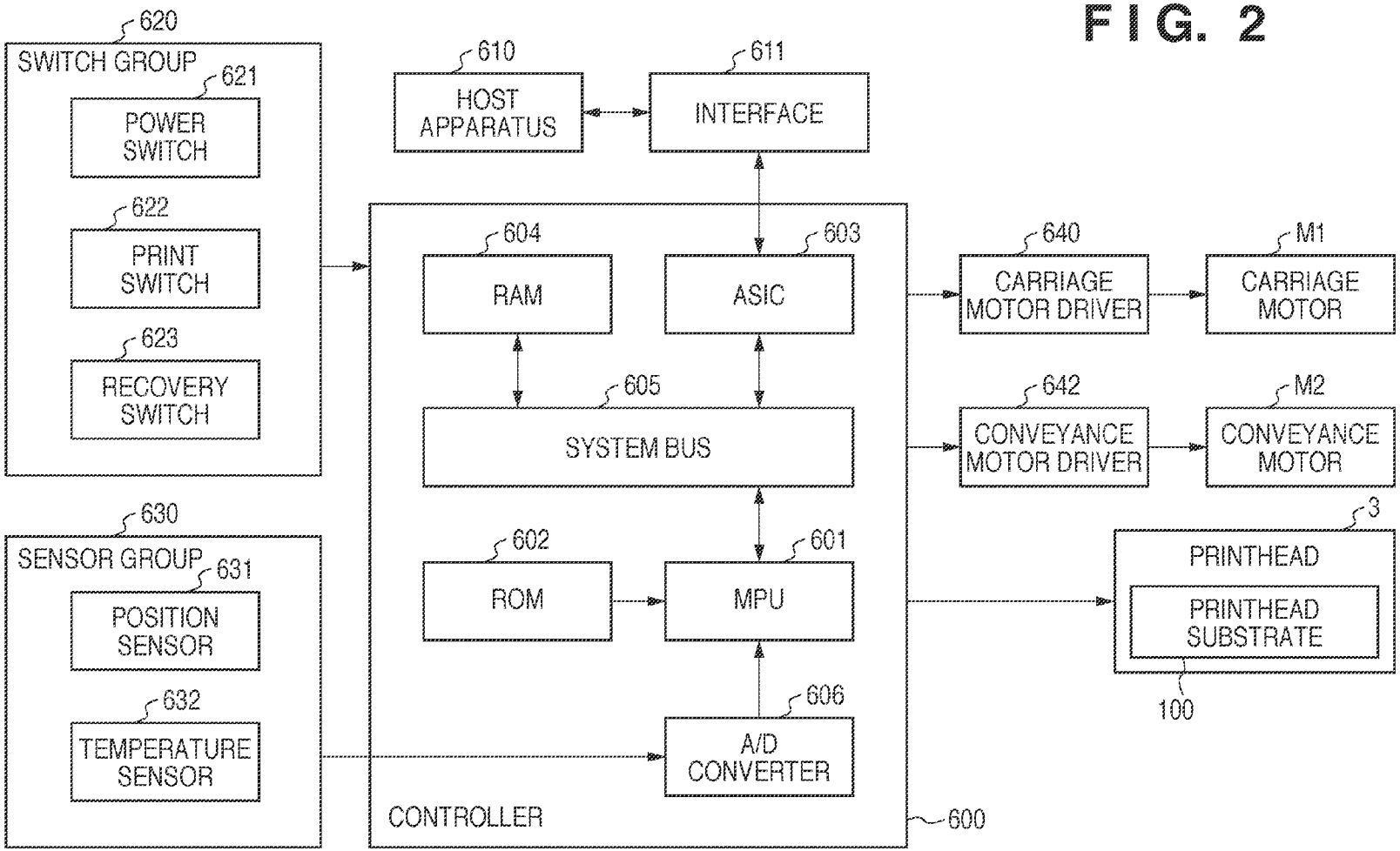
FIG. 2 is a block diagram exemplifying the functional arrangement of the printing apparatus 1 shown in FIG. 1.

FIG. 2 is a block diagram exemplifying the functional arrangement of the printing apparatus 1 shown in FIG. 1.

A controller 600 includes an MPU 601, ROM 602, application specific integrated circuit (ASIC) 603, RAM 604, system bus 605, and A/D converter 606.

The ROM 602 stores programs corresponding to control sequences (to be described later), predetermined tables, and other permanent data. The ASIC 603 controls a carriage motor M1 and conveyance motor M2. Also, the ASIC 603 generates a control signal for controlling the printhead 3. The RAM 604 is used as an image data rasterization area, a work area for executing a program, and the like. The system bus 605 connects the MPU 601, ASIC 603, and RAM 604 to each other so as to exchange data. The A/D converter 606 A/D-converts an analog signal input from a sensor group (to be described later), and supplies the converted digital signal to the MPU 601.

A switch group 620 includes a power switch 621, print switch 622, and recovery switch 623. A sensor group 630 for detecting the apparatus state includes a position sensor 631 and temperature sensor 632.

In print scanning by the printhead 3, the ASIC 603 transfers data to the printhead 3 to drive printing elements (heaters) while directly accessing the storage area of the RAM 604.

The carriage motor M1 is a driving source for reciprocally scanning the carriage 2 in directions indicated by arrow A. A carriage motor driver 640 controls driving of the carriage motor M1. The conveyance motor M2 is a driving source for conveying the printing medium P. A conveyance motor driver 642 controls driving of the conveyance motor M2. The printhead 3 is scanned in a direction (to be referred to as a scanning direction) perpendicular to the conveyance direction of the printing medium P. More specifically, the printhead 3 is scanned relatively to the printing medium. Although details of the printhead 3 will be described later, the printhead 3 includes an inkjet printhead substrate (to be simply referred to as a printhead substrate) 100. The printhead substrate 100 controls the printhead 3 based on printing data input from the controller 600.

A computer 610 (or a reader for reading an image or a digital camera) serves as an image data supply source and is generically called a host apparatus or the like. The host apparatus 610 and printing apparatus 1 exchange image data, commands, status signals, and the like via an interface (to be referred to as an I/F) 611.

Figure 3A:
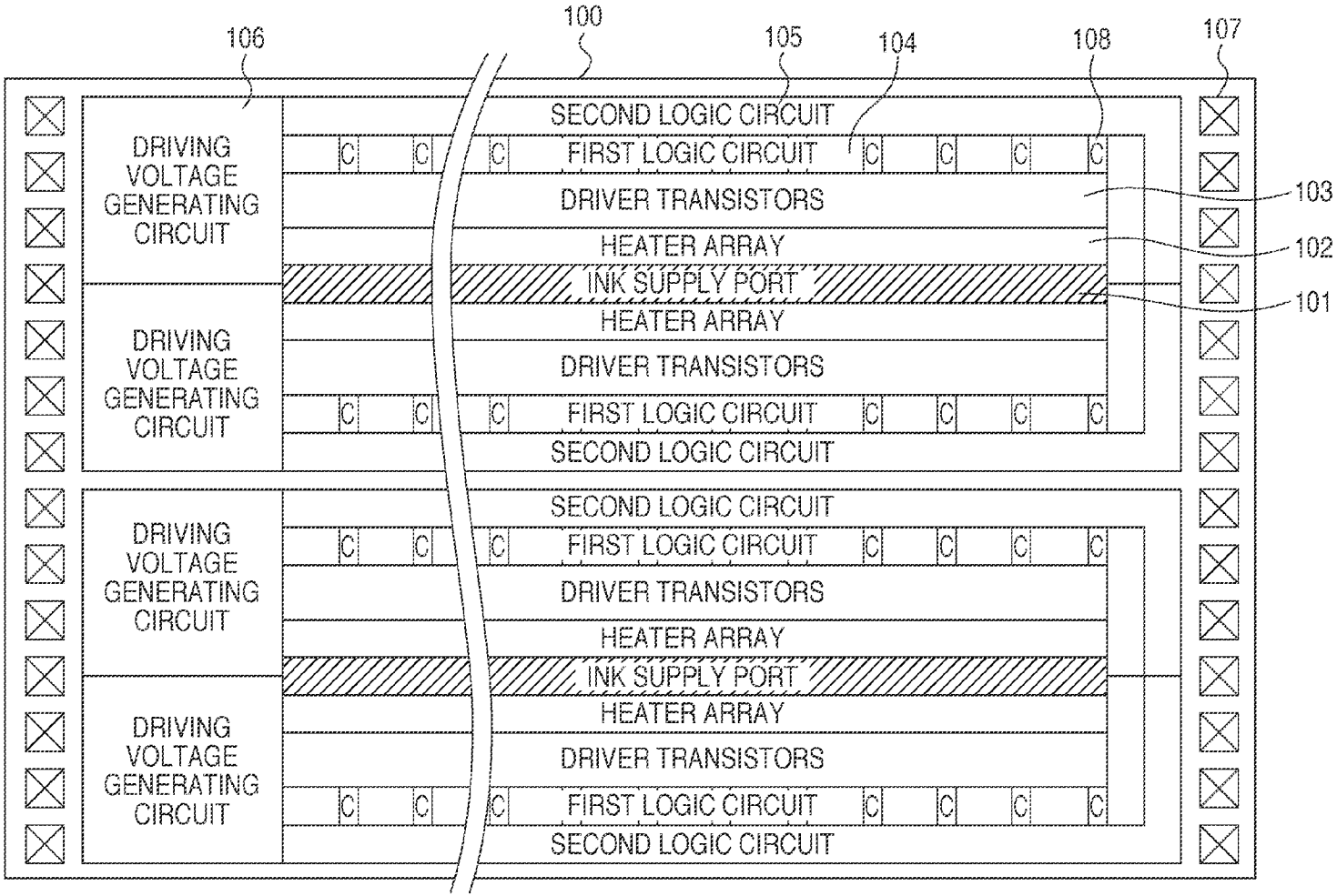
FIGS. 3A and 3B are views exemplifying a printhead substrate 100 shown in FIG. 1.
Figure 3B:
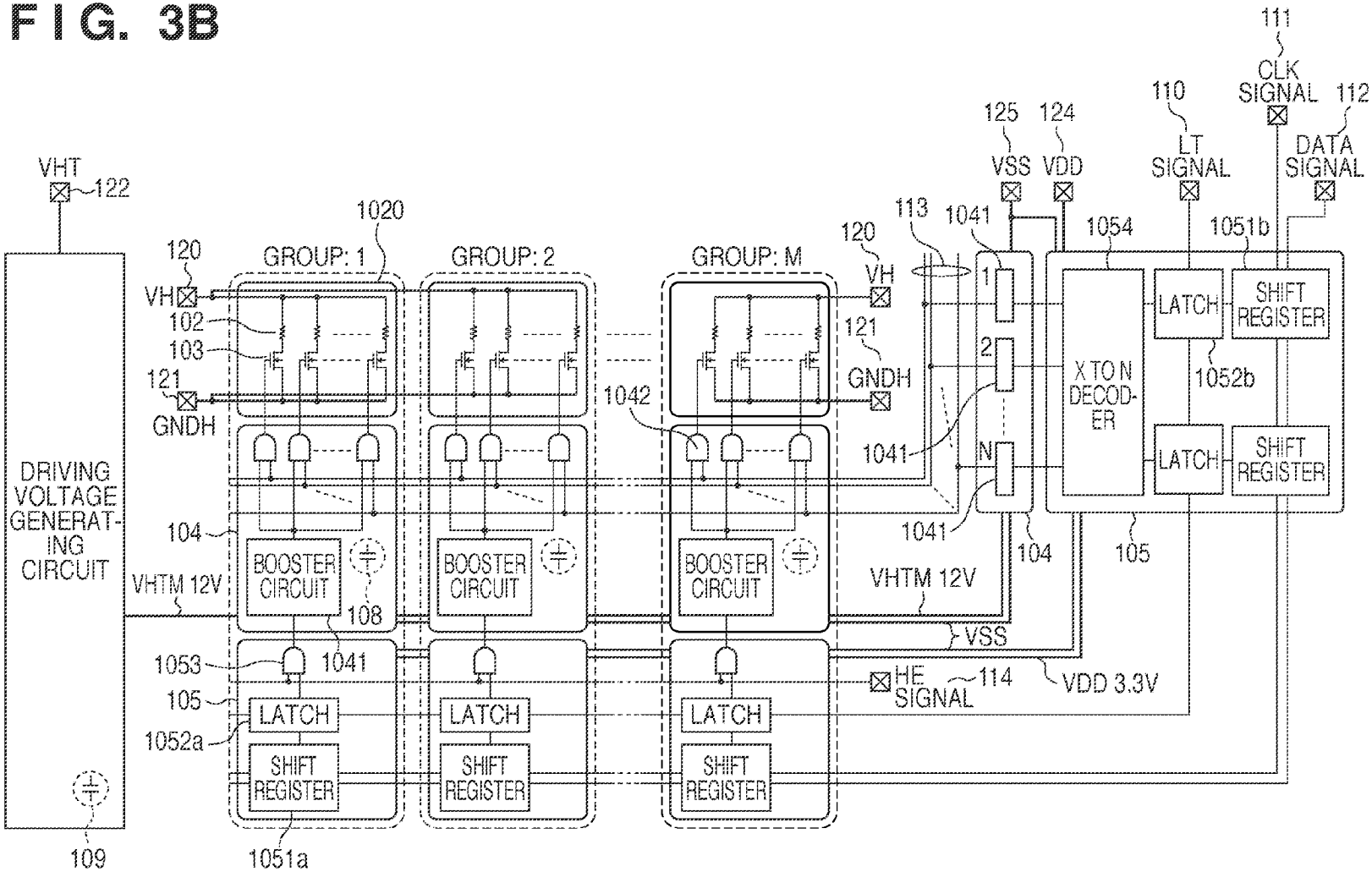

An example of the printhead substrate 100 shown in FIG. 2 will be explained. FIG. 3A is a view exemplifying the circuit layout of the printhead substrate 100 according to the first embodiment. FIG. 3B is a circuit diagram exemplifying a circuit arrangement for driving an array of heat generation elements (to be referred to as heaters) 102 on the printhead substrate 100 shown in FIG. 3A.

The printhead substrate 100 includes the heaters 102. The heaters 102 generate thermal energy used to discharge ink. Switching elements (to be referred to as driver transistors) 103 are driving elements for driving the heaters 102. The heater 102 and driver transistor 103 form a driving circuit 1020. The driving circuit 1020 is arranged in correspondence with each heater 102 (each printing element), and applies a voltage to the heater 102 to drive it.

Each first logic circuit (selection circuit) 104 includes a plurality of AND circuits 1042 and a booster circuit 1041. The AND circuit 1042 functions as a heater selection circuit, and is arranged in correspondence with each heater 102 and each driver transistor 103. The booster circuit 1041 boosts an input voltage to generate a driving voltage for the driver transistor 103. The first logic circuit 104 is arranged in correspondence with a group assigned to a predetermined number of adjacent printing elements. The first logic circuit 104 selects a printing element to be driven from printing elements belonging to the group.

A driving voltage generating circuit 106 converts, into 12 V, a voltage from the same power supply (VHT power supply 122) as that of a 24-V voltage (VH power supply 120) for driving the heater 102. The driving voltage generating circuit 106 supplies the converted voltage to the first logic circuit 104. That is, the first logic circuit 104 is driven at a voltage VHTM of about 12 V.

Figure 9:
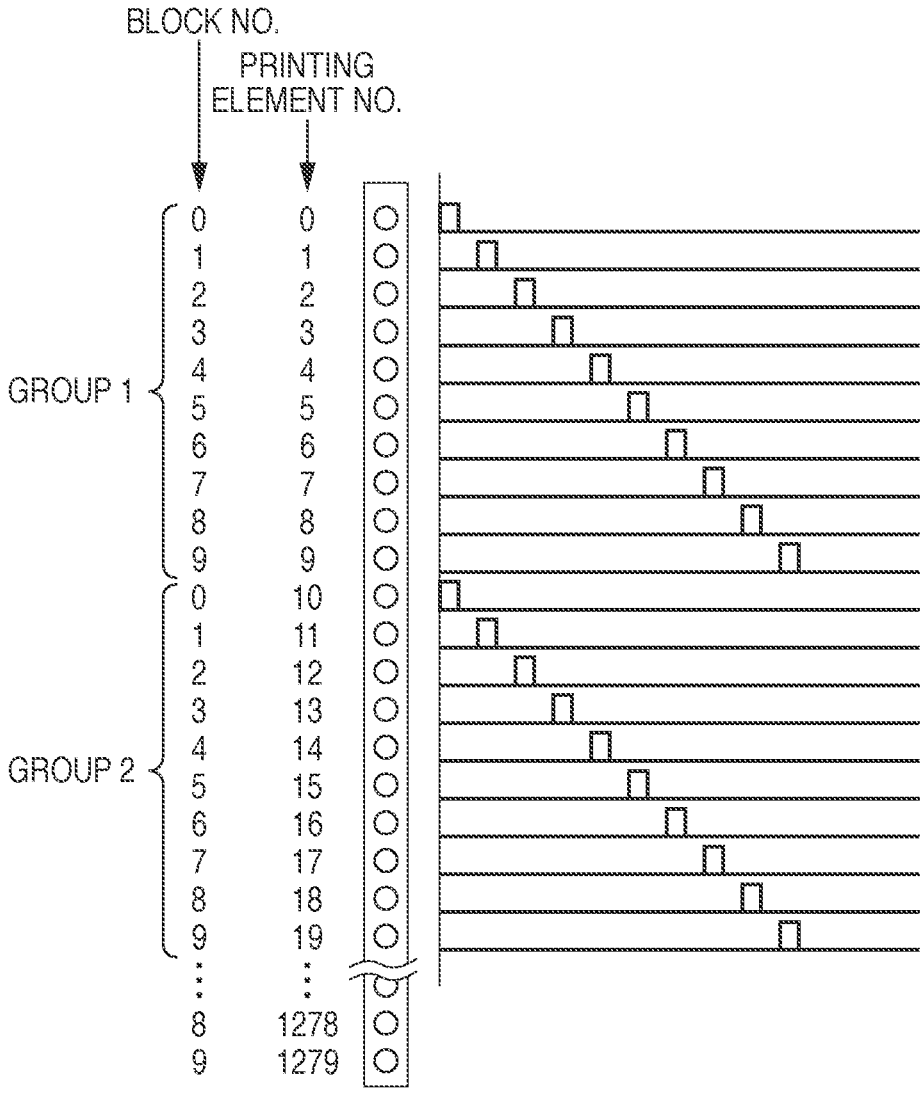
FIG. 9 is a chart for explaining the driving timing of a printing element.

On the printhead substrate 100, the driver transistors 103 and AND circuits 1042 are arranged in correspondence with M×N heaters 102. M groups each containing N (predetermined number of) successive (adjacent) heaters 102 are formed. More specifically, the M×N heaters 102 are divided into groups each containing N heaters 102. The heaters 102 in each group are time-divisionally driven in N driving blocks. In other words, N heaters 102 belonging to each group are driven at different timings. FIG. 9 is a chart for explaining the driving timing of the heater 102. In FIG. 9, one group contains 10 printing elements (heaters), and printing elements having the same block number are driven simultaneously. These printing elements are driven in a predetermined order. The AND circuits 1042 select arbitrary heaters based on the ANDs of outputs DATA from shift registers 1051 which store M data, and outputs from N decoder signals BLE 113.

On the printhead substrate 100, DATA signals 112 corresponding to printing data and time-divisional control data are serially transferred to the shift registers 1051 in synchronism with the timings of CLK signals 111. The shift registers 1051 are roughly classified into two types: shift registers 1051*b* of several bits and shift registers 1051*a* of M bits.

Second logic circuits 105 supply externally input printing data to the first logic circuits 104 which are arranged in correspondence with the respective groups. Each second logic circuit 105 includes an AND circuit 1053, latch 1052*a*, and shift register 1051*a*. The second logic circuits 105 are arranged in correspondence with the respective groups, and output signals (output voltages) to driving elements to be driven in the corresponding groups. The second logic circuits 105 output signals based on the ANDs of printing data signals corresponding to printing data from the latches 1052*a* of M bits (corresponding to the shift registers 1051*a* of M bits) and an HE signal 114 which determines the heating time.

The remaining bits of the data are input to the shift registers 1051*b*, and decoded by a decoder 1054. The decoder 1054 outputs BLE signals 113 (block selection signals) of N bits at the timing when an LT (latch) signal 110 changes to "H". Two or more N BLE signals 113 do not simultaneously change to "H", and only one of them changes to "H".

The printing data signal and BLE signal 113 are boosted to signals of about 12 V by the booster circuit 1041, and then input to the AND circuit 1042, selecting a heater 102 to be driven. The driver transistor 103 is driven by an output from the AND circuit 1042, applying a voltage to the selected heater 102. By repeating this operation N times, the M×N heaters 102 are time-divisionally driven for every M heaters at N timings.

Figure 8A:
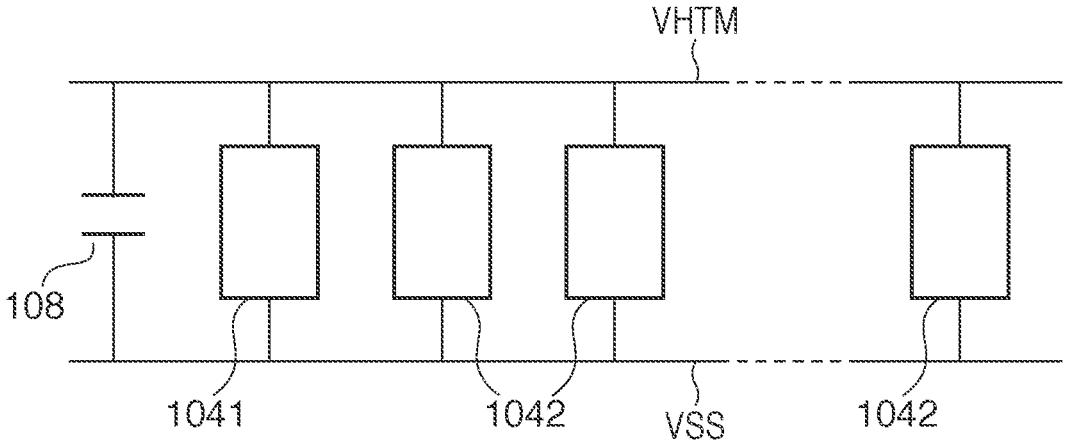
FIG. 8A is a circuit diagram for explaining connection of a capacitor according to the first embodiment.

A capacitor 108 functions as an electricity storage unit and stores charges. As shown in FIG. 3A, a plurality of capacitors 108 are arranged along the arrayed direction of the heaters 102. More specifically, as shown in FIG. 3B, the capacitor 108 is arranged in the first logic circuit 104 in one-to-one correspondence. The capacitor 108 is connected to a power supply line for supplying power from a VHTM power supply (12 V) serving as the power supply of the first logic circuit 104. FIG. 8A is a circuit diagram for explaining the power supply system of the first logic circuit 104 arranged for each group. As shown in FIG. 8A, the capacitor 108 is interposed between the power supply line VHTM and the ground line VSS (GND) in the first logic circuit 104, and parallel-connected to the booster circuit 1041 and AND circuits 1042. Even if a voltage supplied from the driving voltage generating circuit 106 drops, charges stored in the capacitor 108 are removed to compensate for the voltage drop, applying a stable voltage to the first logic circuit 104.

Figure 4:
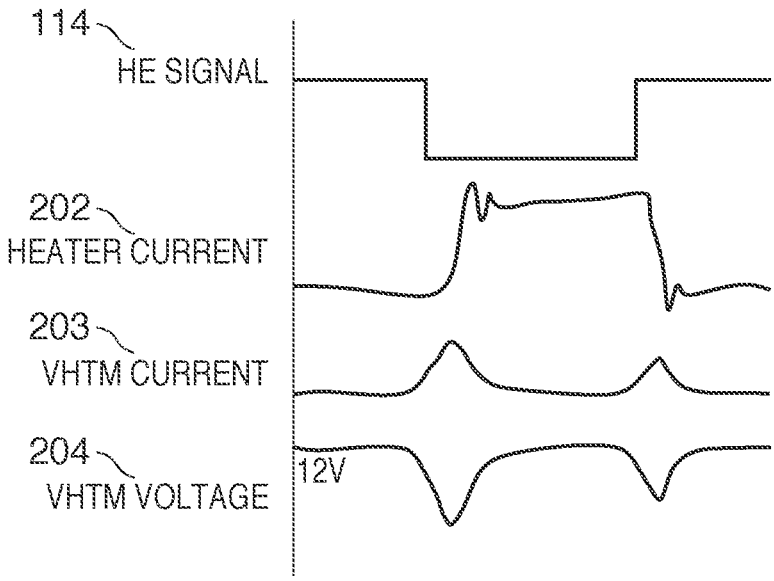
FIG. 4 is a waveform chart showing a signal and current voltage waveforms when driving a heater 102.

FIG. 4 shows a signal and current voltage waveforms when driving the heater 102. At the timing when the HE signal 114 changes to Lo, a current flows through an arbitrary heater 102. A heater current waveform 202 represents a heater current. A current consumption waveform (VHTM current) 203 represents the current consumption of the first logic circuit 104. Referring to the current consumption waveform 203, the current consumption of the first logic circuit 104 becomes large at the leading edge of the heater current (heater current waveform 202). This is because, when driving the driver transistor 103, the gate needs to be charged and a large amount of current needs to be supplied to the gate at once. The flowing current value changes depending on the number of simultaneously driven driver transistors 103. For example, a current of about several ten to several hundred mA flows at once.

Figure 7A:
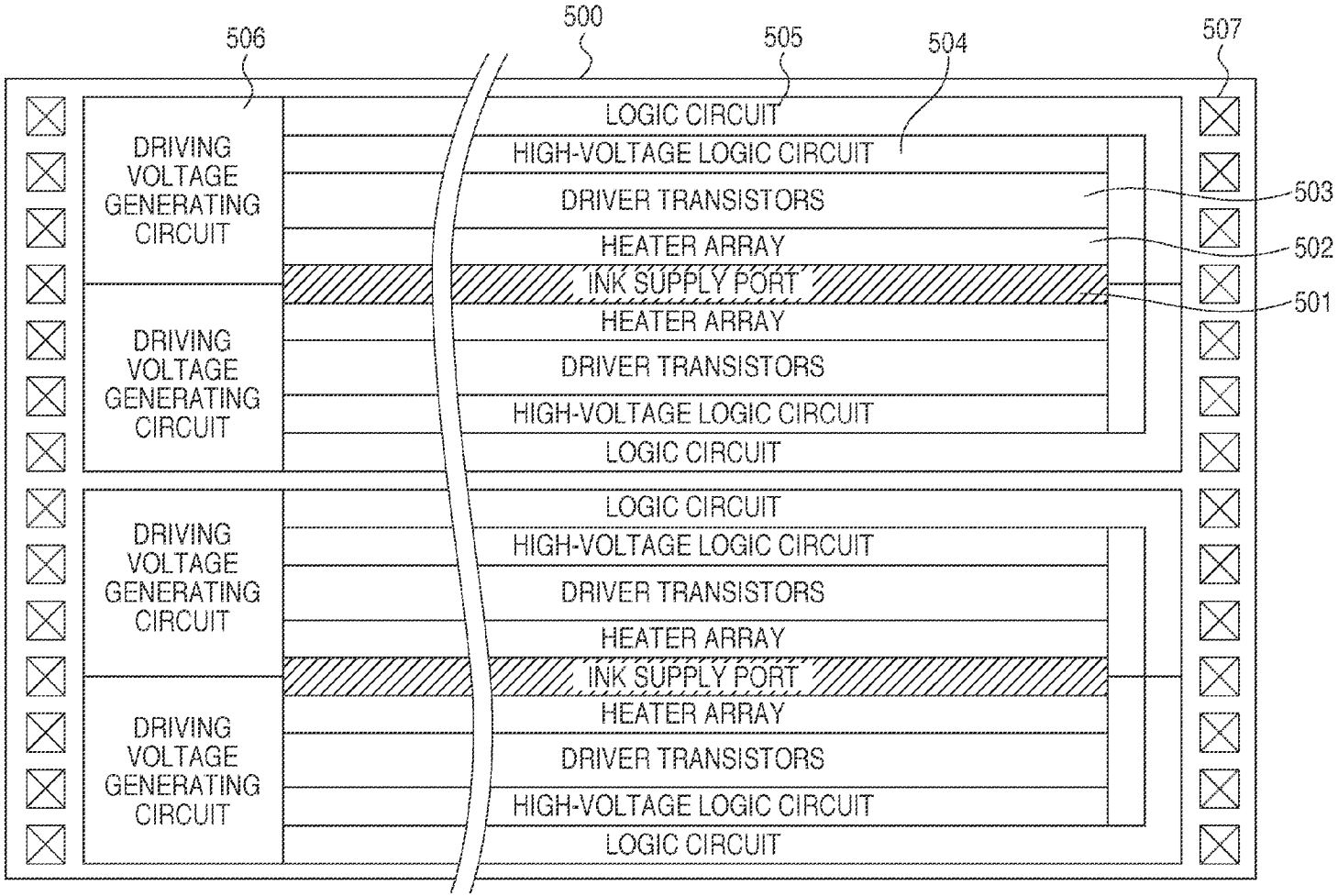
FIGS. 7A and 7B are views exemplifying a conventional technique.
Figure 7B:
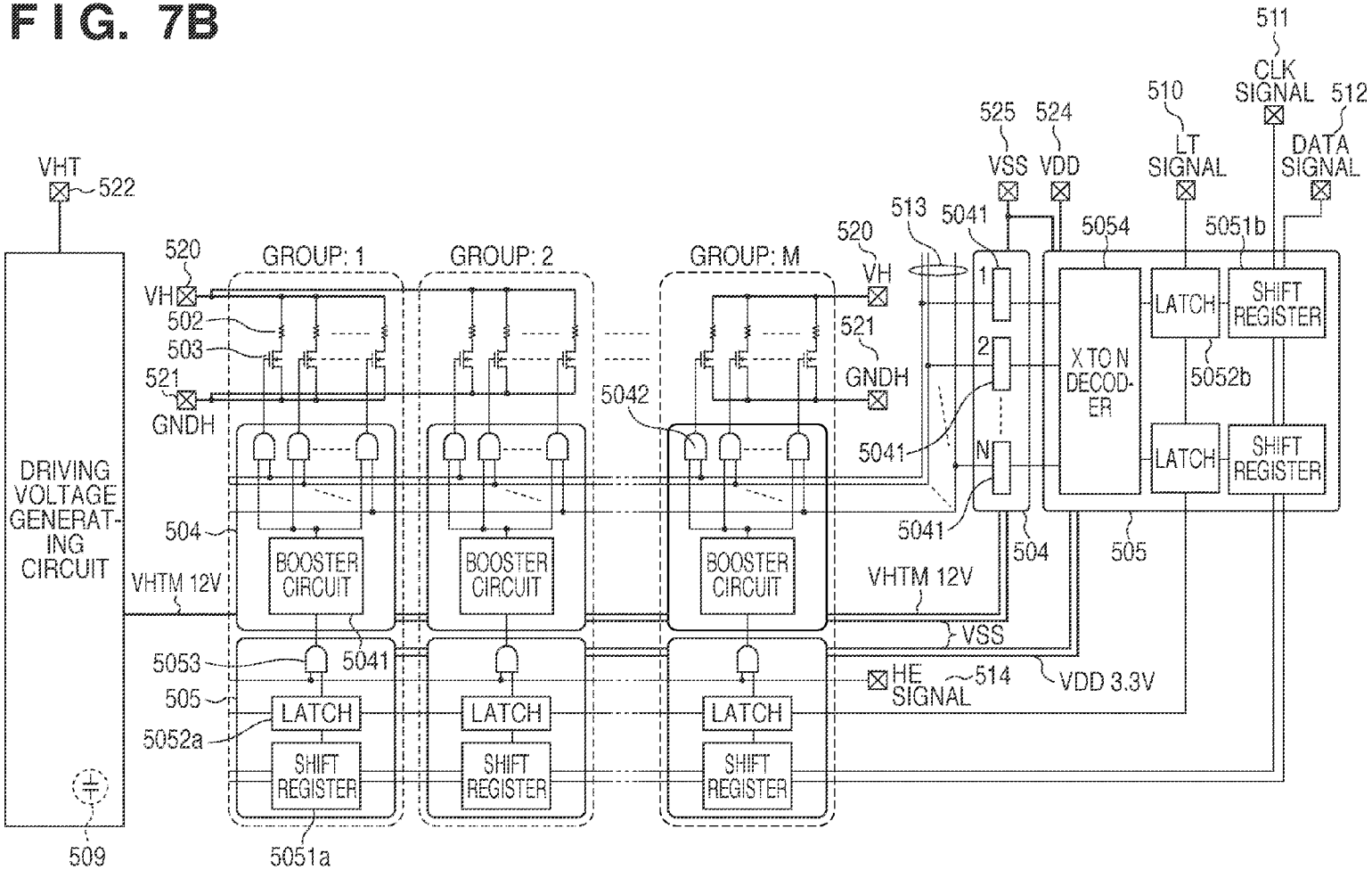

The driving voltage generating circuit 106 at the end of the chip supplies the VHTM power. When driving the driver transistor 103, a voltage drop instantaneously occurs (see a VHTM voltage 204) though the magnitude of the voltage drop changes depending on a flowing current amount. If the voltage drop is large, the drivability of the driver transistor 103 falls for a moment, affecting the leading edge of the heater current waveform 202. In this case, an arbitrary energy may not be able to be supplied to the heater. To suppress this, a power supply stabilization capacitor 509 is conventionally arranged near (at the end of the substrate) the driving voltage generating circuit, as shown in FIG. 7B. The capacitor 509 is connected between VHTM and VSS.

However, since substrates become long recently, the distance between the capacitor 509 and a driver transistor 503 tends to be long, and the capacitor 509 is losing its effect. As the number of simultaneously driven driver transistors 503 increases, the capacitance needs to be increased, too, and the area at the end of the substrate becomes a matter.

From this, in the first embodiment, the capacitor 108 is arranged in each first logic circuit 104, as shown in FIG. 3B. That is, the capacitor 108 is arranged in correspondence with each group. Thus, a driving current is stably supplied to the driver transistor 103 from the neighboring capacitor 108. This reduces the burden of power supply on the driving voltage generating circuit 106, and also reduces the voltage drop of the VHTM power supply when driving the driver transistor 103. This arrangement can drive the heater with higher reliability, compared to not using this arrangement.

Arranging the capacitor 108 decreases a maximum current flowing through the VHTM power supply line (line laid out in the longitudinal direction of the chip). The printhead substrate 100 can therefore be downsized, and the chip width can be shrunken. Even if the substrate is elongated and the number of simultaneously driven driver transistors 103 increases, the capacitance of a capacitor 109 arranged at the end of the substrate need not be increased. Hence, the area at the end of the substrate can be shrunken.

Conventionally, a VHTM power supply whose voltage is set higher than an originally necessary minimum voltage in consideration of the voltage drop is used. However, the arrangement of the first embodiment can minimize the voltage drop of the VHTM power supply and cut the upper margin of the voltage. As a consequence, the VHTM voltage can be set low. This technique is therefore effective even for a printhead substrate using a driver transistor whose gate oxide film is thin (gate breakdown voltage is low). Note that a MOSFET, which is not limited to the driver transistor, improves its performance by thinning the gate oxide film. It is necessary to thin the gate oxide film for a next-generation high-performance printhead substrate.

As described above, according to the first embodiment, the power supply on the substrate can be stabilized to drive heaters with higher reliability, compared to not using the arrangement of the first embodiment. Further, shrinking the chip width contributes to cost reduction and improvement of the performance of the printhead substrate.

Second Embodiment

Figure 5A:
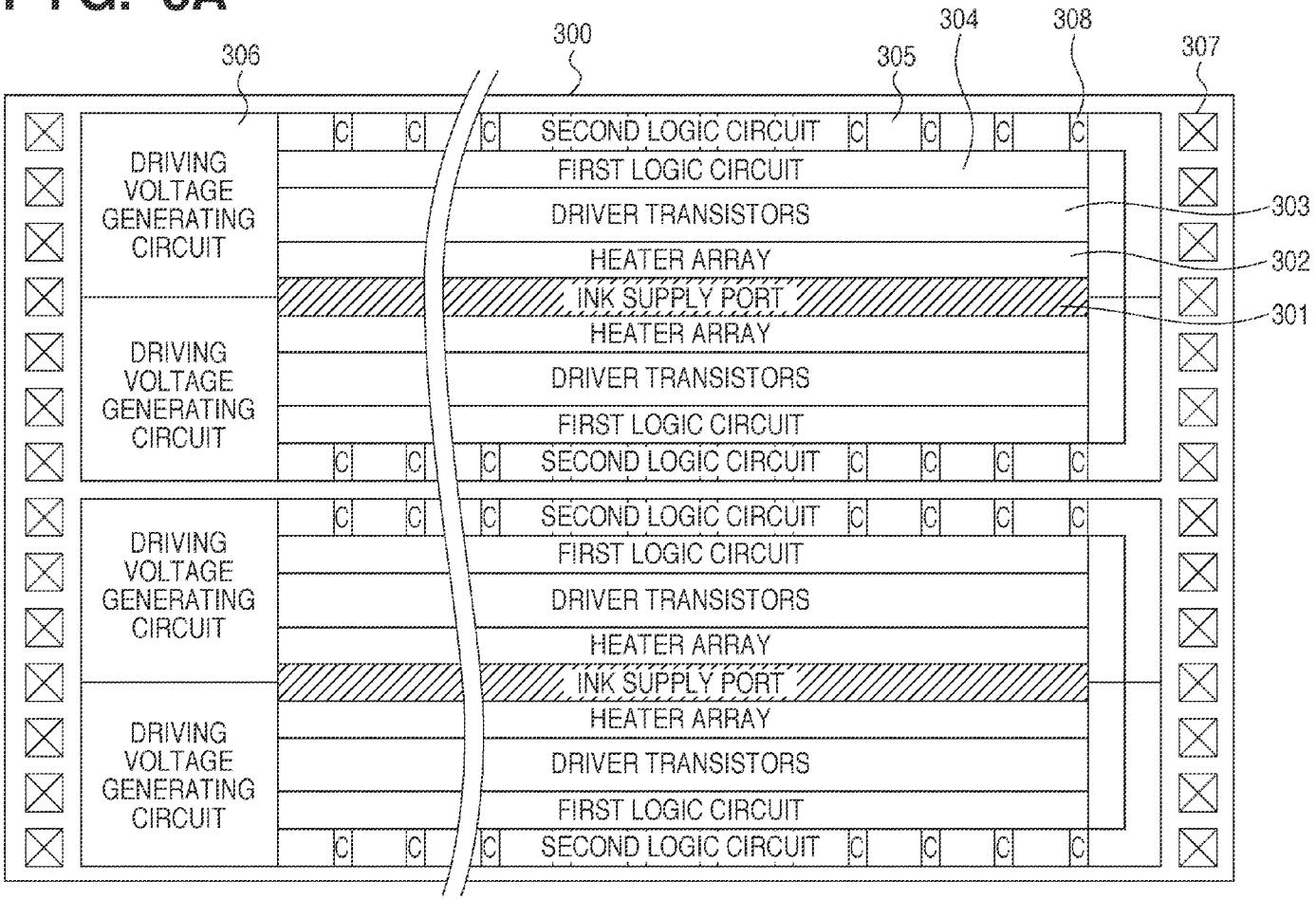
FIGS. 5A and 5B are views exemplifying a printhead substrate 300 according to the second embodiment.
Figure 5B:
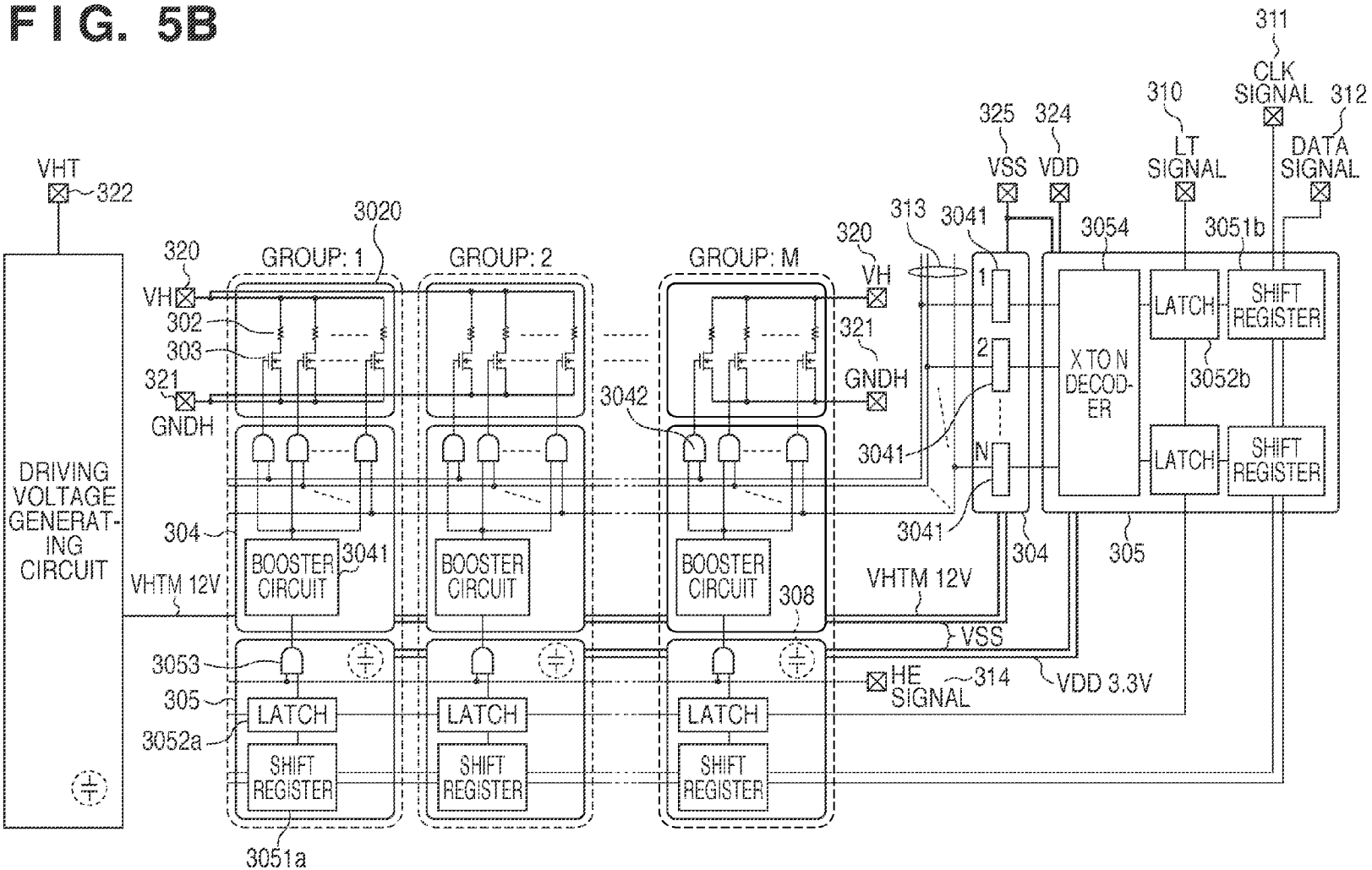

The second embodiment will be described. FIG. 5A is a view exemplifying the circuit layout of a printhead substrate 300 according to the second embodiment. FIG. 5B is a circuit diagram exemplifying a circuit arrangement for driving an array of heaters 302 on the printhead substrate 300 shown in FIG. 5A. Note that the arrangement of a printing apparatus 1 and that of the printhead substrate 300 according to the second embodiment are almost the same as those in FIGS. 1, 2, 3A, and 3B described in the first embodiment, a detailed description thereof will not be repeated, and a difference will be mainly explained. Note that references 300 to 308 shown in FIG. 5A correspond to references 100 to 108 shown in FIG. 3A respectively. For example, reference 301 shown in FIG. 5A corresponds to reference 101 shown in FIG. 3A. Also, for example, reference 302 shown in FIG. 5A corresponds to reference 102 shown in FIG. 3A. Furthermore, references 302 to 3054 shown in FIG. 5B correspond to references 102 to 1054 shown in FIG. 3B respectively. For example, reference 3020 shown in FIG. 5B corresponds to reference 1020 shown in FIG. 3B. Also, for example, reference 3041 shown in FIG. 5B corresponds to reference 1041 shown in FIG. 3B.

Figure 8B:
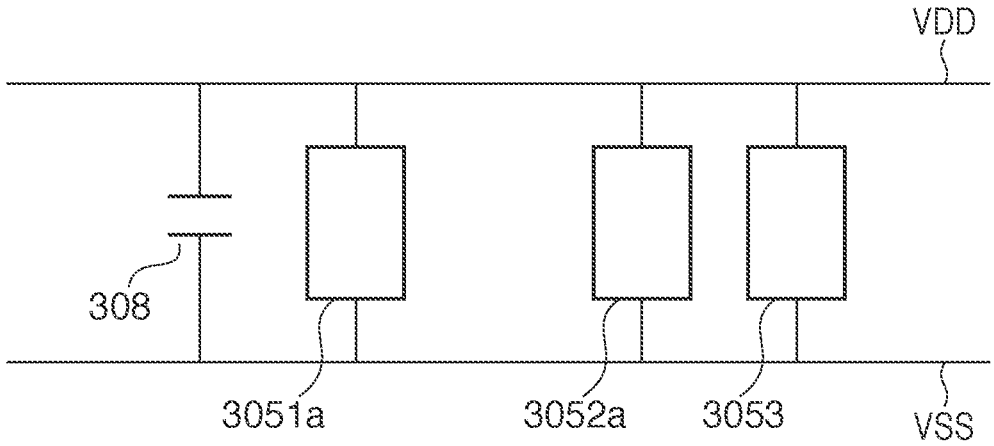
FIG. 8B is a circuit diagram for explaining connection of a capacitor according to the second embodiment.

As shown in FIG. 5A, a plurality of capacitors 308 are arranged along the arrayed direction of the heaters 302. More specifically, as shown in FIG. 5B, the capacitor 308 is arranged in a second logic circuit 305 in one-to-one correspondence. The capacitor 308 is connected to a power supply line for supplying power from a VDD power supply 324 (3.3 V) serving as the power supply of the second logic circuit 305. FIG. 8B is a circuit diagram for explaining the power supply system of the second logic circuit 305 arranged for each group. As shown in FIG. 8B, the capacitor 308 is interposed between the power supply line VDD and the ground line VSS in the second logic circuit 305, and parallel-connected to a shift register 3051*a*, latch 3052*a*, and AND circuit 3053. Even if a voltage supplied from the VDD power supply 324 drops, charges stored in the capacitor 308 are removed to compensate for the voltage drop, applying a stable voltage to the second logic circuit 305.

As described above, according to the second embodiment, the power supply of the second logic circuits 305 arranged along the array of the heaters 302 is stabilized, relaxing the influence of power supply noise. Since the power supply is stabilized, this arrangement is also applicable to a logic circuit using a microsemiconductor process with a low VDD voltage. The performance of the printhead substrate can be improved, and the logic circuit can be driven quickly. This arrangement can cope with even a long substrate and a large number of heaters.

Third Embodiment

Figure 6A:
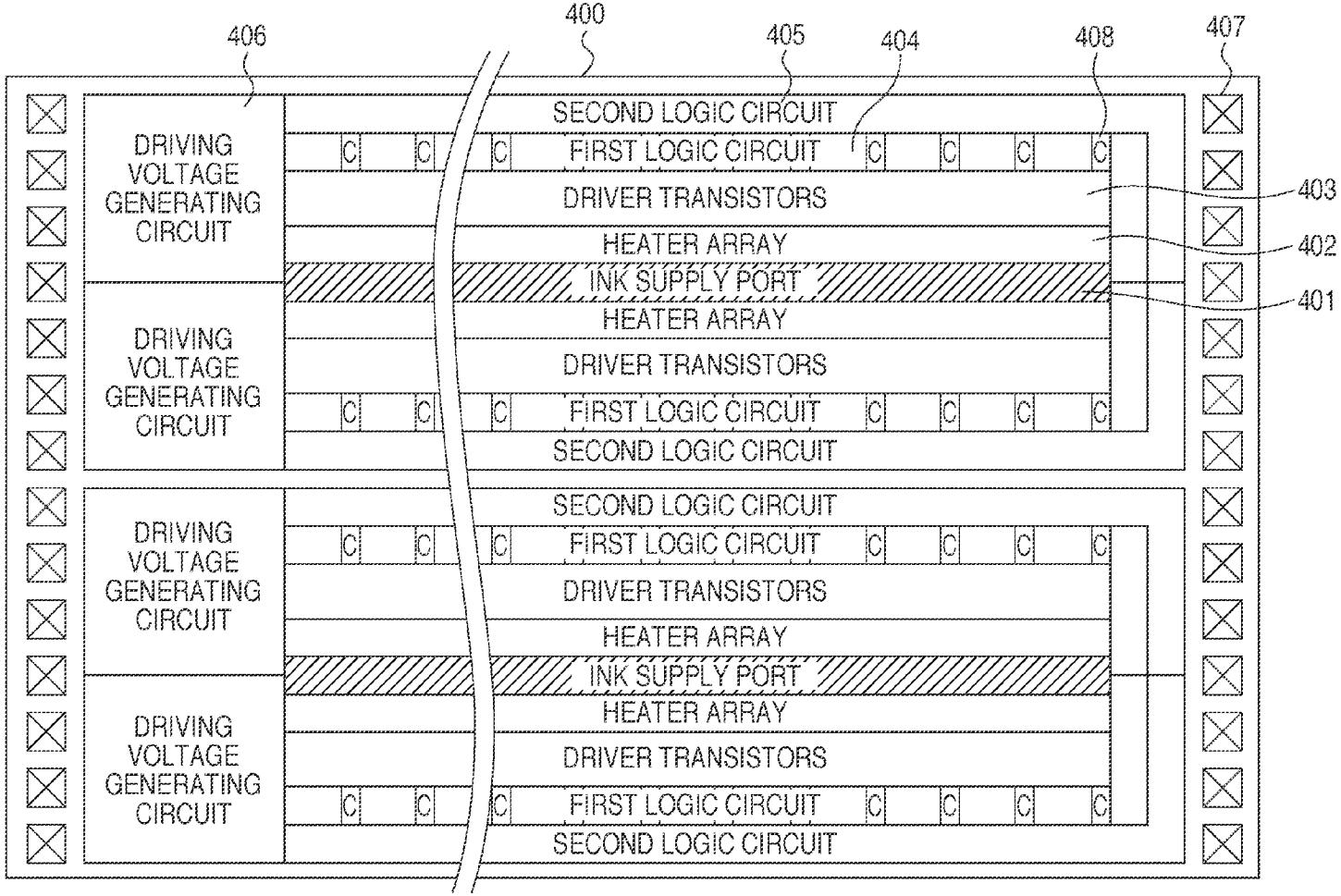
FIGS. 6A and 6B are views exemplifying a printhead substrate 400 according to the third embodiment.
Figure 6B:
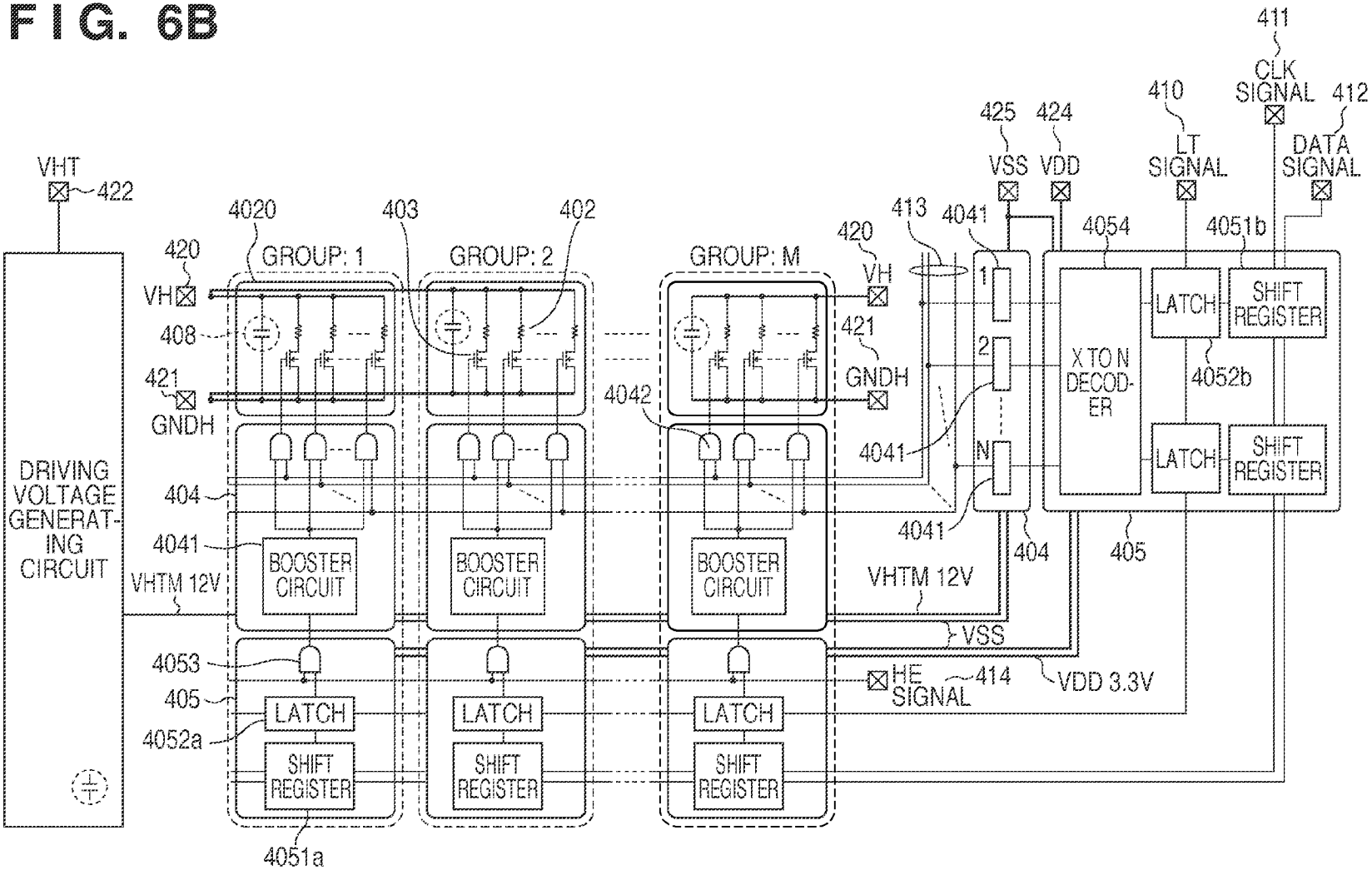

The third embodiment will be described. FIG. 6A is a view exemplifying the circuit layout of a printhead substrate 400 according to the third embodiment. FIG. 6B is a circuit diagram exemplifying a circuit arrangement for driving an array of heaters 402 on the printhead substrate 400 shown in FIG. 6A. Note that the arrangement of a printing apparatus 1 and that of the printhead substrate 400 according to the third embodiment are almost the same as those in FIGS. 1, 2, 3A, and 3B described in the first embodiment, a detailed description thereof will not be repeated, and a difference will be mainly explained. Note that references 400 to 408 shown in FIG. 6A correspond to references 100 to 108 shown in FIG. 3A respectively. For example, reference 401 shown in FIG. 6A corresponds to reference 101 shown in FIG. 3A. Also, for example, reference 402 shown in FIG. 6A corresponds to reference 102 shown in FIG. 3A. Furthermore, references 402 to 4054 shown in FIG. 6B correspond to references 102 to 1054 shown in FIG. 3B respectively. For example, reference 4020 shown in FIG. 6B corresponds to reference 1020 shown in FIG. 3B. Also, for example, reference 4041 shown in FIG. 6B corresponds to reference 1041 shown in FIG. 3B.

As shown in FIG. 6A, a plurality of capacitors 408 are arranged along the arrayed direction of the heaters 402. More specifically, as shown in FIG. 6B, the capacitor 408 is connected to a power supply line for supplying power from a VH power supply 420 (24 V). The capacitor 408 is arranged in a driving circuit 4020 arranged for each group, and parallel-connected to the connection between the heaters 402 and driver transistors 403. Note that the driver transistors 403 are generally aligned at the same intervals as the array pitches of the heaters 402. When the width of the driver transistor 403 is smaller than this pitch, the capacitor 408 can be arranged by shortening the distance between the transistors. Hence, even if a voltage supplied from the VH power supply 420 drops, charges stored in the capacitor 408 are discharged to compensate for the voltage drop, applying a stable voltage to the driver transistor 403.

As described above, according to the third embodiment, a current is stably supplied to the heaters 402, relaxing power supply noise. This enables high-reliability heater driving. By arranging the capacitor 408, a current pulse flowing through an aluminum wire running immediately above the circuit rises and falls gently. This decreases noise applied to the VDD power supply, VHTM power supply, VHT power supply, first logic circuit, second logic circuit, driver transistor, driving voltage generating circuit, and the like, improving the circuit driving reliability.

Typical embodiments of the present invention have been exemplified. However, the present invention is not limited to the above-described and illustrated embodiments, and can be properly changed and modified without departing from the scope of the invention.

For example, in the first to third embodiments, one capacitor 108, 308, or 408 is arranged in one group, but the present invention is not limited to this. For example, two or more capacitors may be arranged in one group. The capacitor 108 between VHTM and VSS, the capacitor 308 between VDD and VSS, and the capacitor 408 between VH and GNDH are more preferably arranged in one group simultaneously. One capacitor 108, 308, or 408 may be arranged in two or more groups. For example, even when one capacitor 108 described in the first embodiment is arranged in two groups by doubling its capacitance, the same effects as those in the first embodiment can be obtained. Arranging identical elements at once increases the layout efficient, obtaining the substrate shrinking effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-269264 filed on Nov. 26, 2009, which is hereby incorporated by reference herein in its entirety.

What is claimed is:

1. A printhead substrate comprising:

a plurality of printing elements arrayed in a predetermined direction;

logic circuits arranged in correspondence with respective groups each assigned to a predetermined number of adjacent printing elements, and configured to output signals for driving said printing elements;

driving circuits configured to drive said printing elements based on the signals output from said logic circuits; and capacitors arranged in the respective groups, connected to a power supply line for supplying power to at least one of said logic circuits and said driving circuits, and configured to store charges in accordance with a voltage applied through the power supply line.

2. The substrate according to claim 1, wherein the capacitors are arranged in said driving circuits, respectively, and connected to a power supply line of said driving circuits.

3. The substrate according to claim 1, wherein the capacitors are arranged along an arrayed direction of said printing elements.

4. A printhead on which a printhead substrate according to claim 1 is mounted.

5. A printing apparatus comprising a printhead on which a printhead substrate according to claim 1 is mounted, wherein said printing apparatus prints by scanning said printhead relatively to a printing medium.

6. The substrate according to claim 1, wherein said logic circuits include:

first logic circuits, each configured to select one of the adjacent printing elements belonging to each of the groups, and second logic circuits configured to supply signals based on externally input printing data to said first logic circuits, respectively.

7. The substrate according to claim 6, wherein the capacitors are arranged in correspondence with said first logic circuits and connected to a power supply line of said first logic circuits.

8. The substrate according to claim 6, wherein the capacitors are arranged in correspondence with said second logic circuits and connected to a power supply line of said second logic circuits.

* * * * *